United States Patent [19]

Burns

[11] 4,322,219

[45] Mar. 30, 1982

[54] MOISTURE REDUCTION

[75] Inventor: Edward J. Burns, Omaha, Nebr.

[73] Assignee: InterNorth, Inc., Omaha, Nebr.

[21] Appl. No.: 239,411

[22] Filed: Mar. 2, 1981

[51] Int. Cl.[3] ..... C10L 9/10

[52] U.S. Cl. ..... 44/6; 44/25

[58] Field of Search ..... 44/6, 1 G, 25–27

[56] References Cited

U.S. PATENT DOCUMENTS

| | | | |
|---|---|---|---|
| 3,020,229 | 2/1962 | Thompson et al. | 210/54 |
| 3,232,720 | 0/1966 | Kepple | 44/6 |
| 3,630,695 | 0/1971 | Duling | 44/6 |
| 4,214,875 | 7/1980 | Kromrey | 44/6 |

OTHER PUBLICATIONS

Baichenko, A. A.; "Thickening and Filtration of Coal Flotation Toilings", *Chemical Abstract,* vol. 82, 1975, p. 149.

*Primary Examiner*—Carl F. Dees
*Assistant Examiner*—Margaret B. Medley
*Attorney, Agent, or Firm*—Donald F. Haas

[57] ABSTRACT

A method for reducing the moisture content of coal is described which comprises contacting coal with an aqueous solution of at least 0.1 percent of polyethylene oxide with a molecular weight of at least 200,000 so that at least 1 gram of polyethylene oxide per 1000 grams of coal is deposited upon the coal, and then evaporating the water. The preferred method for contacting the coal with the aqueous solution is by spraying the solution onto the coal.

9 Claims, No Drawings

MOISTURE REDUCTION

BACKGROUND OF THE INVENTION

The present invention relates to the reduction of the moisture content of coal and, more particularly, to a composition and a method of treating coal with the composition to reduce the moisture content of the coal.

Most electric utilities east of the Mississippi River have boilers designed for burning coal having a lower moisture content than is generally found in coal from the western United States. For these utilities, or other users of coal having boilers designed for low-moisture coal, to use western coal without derating the boilers, a portion of the inherent moisture of the coal must be removed. The benefits of drying high-moisture, low-sulfur western coal are:

(1) lower transportation costs,
(2) improved burning qualities of the coal,
(3) lower boiler operating and maintenance costs, and
(4) increased boiler capacity.

The known methods for drying coal are both thermal methods. One such thermal drying process uses a roto-louvre dryer to dry ¾ inch coal to a moisture content of 10 to 15 percent. The coal is subjected to a temperature of 400° C. to achieve drying, cooled using ambient temperature air, and then coated with oil or another sealant to prevent the reabsorption of water. A second method is similar to the first except that the coal is subjected to gas heated to about 260° C. to achieve drying. Coating of the coal after drying is also necessary in the second method. These methods have significant problems. First, dust control during drying and before sealing is a significant problem. Second, these severe drying methods can result in the loss of low boiling volatile hydrocarbons, nitrogen, carbon monoxide, and carbon dioxide from the coal. Neither the dust nor the low boiling hydrocarbons can be vented to the atmosphere without causing serious environmental problems. Normally, they are controlled using expensive environmental equipment.

The present invention provides a composition and a method for reducing the moisture content of coal which achieves the desired advantages without the aforementioned disadvantages. The moisture content of coal can be reduced by 50 percent or more with the method of this invention. Surprisingly, the moisture reduction is accomplished by adding to the coal an aqueous solution which is then evaporated, leaving a residue of polyethylene oxide. Another advantage of using polyethylene oxide solutions in the present method is that it avoids the tendency of high moisture low-rank coal to slack or degrade in size when it is being dried.

Bureau of Mines Report of Investigations No. 8349 entitled "Flocculation Dewatering of Florida Phosphatic Clay Wastes" by Annie G. Smelley and I. L. Feld, published in 1979 by the United States Department of the Interior, discloses the use of polyethylene oxide as an organic flocculant to assist in the disposal of phosphatic clay wastes and reclaiming mined land. Such clay wastes are difficult to remove from water because of their colloidal properties. When polyethylene oxide is added to such a colloidal suspension, it causes the clay wastes to agglomerate into a coherent plastic mass and up to 94 percent of the water can be removed in the form of a clear liquid. High molecular weight polyethylene oxide has also been used as a flocculant for coal flotation tailings (*Chemical Abstracts,* Vol. 82, p. 142463, abstract 142458X). The above uses of polyethylene oxide are clearly distinguishable from the present invention since solids are agglomerated and removed from primarily liquid systems whereas in the present invention, moisture is removed from a primarily solid system.

SUMMARY OF THE INVENTION

Briefly described, the invention herein is a method for removing moisture from coal by contacting the coal with a moisture reduction composition which is comprised of polyethylene oxide and water, and then exposing the coal to ambient conditions to allow the water in the solution to evaporate. At least about one gram of polyethylene oxide per 1000 grams of coal must be deposited on the coal. The molecular weight of be at least about 200,000. Depending upon the molecular weight of the polyethylene oxide used, the concentration of polyethylene oxide in water can be as little as about 0.1 percent.

In a preferred embodiment of the invention, polyethylene oxide with a molecular weight of about 900,000 is contacted in aqueous solution with coal such that the coal is coated with at least about 20 grams of polyethylene oxide per 1000 grams of coal. In a highly preferred embodiment, polyethylene oxide with a molecular weight of about 4,000,000 is contacted with coal in aqueous solution such that at least about 1 gram of polyethylene oxide per 1000 grams of coal is deposited on the coal. An alcohol, such as methanol, can be included in the aqueous solution. The polyethylene oxide, water, and alcohol solution provides the advantage of that the evaporation time is significantly decreased.

DETAILED DESCRIPTION OF THE INVENTION

It has been found that the application of at least about 1 gram of polyethylene oxide per 1000 grams of coal from a solution of at least about 0.1 percent polyethylene oxide in water to coal and then allowing the water in the solution to evaporate will remove from the coal a substantial amount of the moisture contained therein. The moisture content can be decreased at least 20 percent and up to 50 percent and more under the right conditions. For purposes of the description in this application and the claims, the term "coal" means a natural solid combustible material consisting of amorphous elemental carbon with various amounts of hydrocarbons, complex organic compounds, and inorganic materials and includes, as well as the well-known types, peat which is, geologically, a very young coal. This invention is useful for untreated run of mine coal, coal which has been treated to remove the heavy components, and coal from a coal slurry pipeline.

Polyethylene oxide is a crystalline, thermoplastic, water-soluble polymer with the general formula $HOCH_2(CH_2OCH_2)_nCH_2OH$ or $H(OCH_2CH_2)_nOH$. The end groups are said to be hydroxyl groups only in the case of the lower molecular weight species. Unlike most polymer systems, polyethylene oxide is commercially available in an extraordinarily wide range of molecular weights from ethylene glycol, diethylene glycol, and so on, up to polymers that have molecular weights many times greater than a million. The lower molecular weight members of the series with n up to about 130 (molecular weight from about 200 to about 6000) are generally known as polyethylene glycols while the higher members (molecular weight greater than 6500 up to 100,000 to several million) are known as polyethylene oxide, polyoxyethylene, or polyoxirane. The preferred polyethylene oxide polymers for use in the present invention have a molecular weight of at least about 200,000 and, theoretically, there is no maximum. Insufficient moisture reduction occurs when polyethylene oxides with molecular weights of 100,000 or less are used.

The higher (polyethylene oxide) and lower (polyethylene glycol) molecular weight members of this series differ sufficiently in properties as to form two classes. The lower members range from relatively viscous fluids to wax-like solids while the higher members are true thermoplastics capable of being formed into tough, molded shapes. The property differences of these two classes are due principally to large differences in molecular weight and the relatively greater importance, therefore, of the end groups in the low molecular weight class.

The polyethylene oxide polymers used in the present invention are made by conventional processes such as suspension polymerization or condensation of ethylene oxide. The composition of the present invention is prepared by dissolving the proper amount of polyethylene oxide in a measured amount of water. This may be accomplished by any conventional method, but we have found that simply mixing the polyethylene oxide in warm water (30° C. to 70° C.) is sufficient to provide the desired composition.

I have found that if less than about 0.01 percent of polyethylene oxide is used in the aqueous composition, then insufficient moisture reduction will take place even though some moisture will be removed from the coal. The upper limit of the polyethylene oxide concentration is a practical one and is limited only by the maximum amount of polyethylene oxide which can be dissolved in water without forming a gel. This depends upon the molecular weight of the polyethylene oxide. The highest concentration known to me that does not gelate is 83 percent, but in almost all cases, no more than 50 percent should be necessary. In general, as the concentration is increased, moisture reduction is also increased.

I have determined that at least about 1 gram of polyethylene oxide per 1000 grams of coal must be applied to the coal in order to achieve the advantages of the present invention. If less than this amount is applied to the coal, then insufficient moisture reduction takes place. Theoretically, there is no maximum amount of polyethylene oxide which can be applied to the coal to achieve the advantages of the present invention. However, we have determined that, from a practical standpoint, it is not necessary to apply more than about 100 grams of polyethylene oxide per 1000 grams of coal to achieve a 50 percent reduction in the moisture content of the coal. The minimum amount of polyethylene oxide which must be applied to the coal varies with the molecular weight of the polyethylene oxide used. In general, the amount of polyethylene oxide necessary to provide the advantages of the present invention decreases as the molecular weight increases.

The preferred method for treating coal to reduce its moisture content according to the present invention comprises spraying so that the solution completely covers the coal. Another preferred method comprises completely immersing the coal in a solution of polyethylene oxide and water in the indicated concentration range. It is important that the coal be completely coated with the composition. Next, if the immersion method has been used, the polyethylene oxide solution is decanted from the coal. Any means of removing the solution from the coal may be used except water washing. Finally, the coal is exposed to ambient conditions with a temperature above about 0° C. for a period sufficient to evaporate the liquid in the solution, generally at least about 2 hours. A shorter exposure period may result in too much moisture in the coal. The resulting product is a low moisture, dust-free coal achieved without removing volatile hydrocarbons, carbon monoxide, carbon dioxide, or nitrogen from the coal. Other methods for contacting the coal include slurrying, painting, and rinsing.

It is theorized that the polyethylene oxide acts as a transmitting agent for water in the following manner. During mixing, most of the coal surface moisture is absorbed into the solution. The polyethylene oxide solution migrates into the coal pores and absorbs the inherent moisture which remains in the pores. It is further theorized that during evaporation the inherent moisture is then transmitted to the surface.

The following examples are meant to illustrate the invention and not to limit it in any way.

EXAMPLE 1

The polyethylene oxide used in this example and the following example was POLYOX ® WSR-1105, manufactured by Union Carbide, and has the following characteristics: an approximate molecular weight of 900,000 and a 5 percent solution viscosity of 800 to 17,600 centipoises at 25° C. The coal was a lignite found near Stanton, N. Dak. from the Hagel seam of the North Great Plains Coal Province, Fort Union Region.

Five 10-gram samples of coal were treated by immersion in polyethylene oxide solutions of varying concentrations. After immersion in the solution, the coal was vigorously stirred for 15 minutes to complete contact of the coal with the solution. Then the solution was decanted from the coal and the coal was exposed to ambient conditions for about 24 hours. An untreated coal sample was also exposed to ambient conditions for 24 hours. After the 24-hour exposure period, the moisture content of the samples was determined in triplicate using a Perkin-Elmer TGS-II.

| Sample | Solution Strength (% PEO) | Moisture Content (%) Trial 1 | Trial 2 | Trial 3 | Average |
|---|---|---|---|---|---|
| 1 | 1% | 18.14 | 17.98 | 17.50 | 17.87 |
| 2 | 2% | 6.79 | 6.21 | 6.54 | 6.51 |
| 3 | 0.5% | 24.36 | 24.09 | 24.01 | 24.15 |
| 4 | 4% | 6.99 | 7.21 | 7.01 | 7.07 |
| 5 | 0.1% | 16.89 | 16.45 | 17.20 | 16.82 |
| Control | — | 16.82 | 16.91 | 16.51 | 16.74 |

It is clear from the above that the immersion of coal in polyethylene oxide solutions of 2 percent and 4 percent greatly reduces the moisture content of the coal.

EXAMPLE 2

A 20-gram coal sample was separated into two portions and treated as follows. Sample 1 was not treated with polyethylene oxide solution, but was exposed to 21° C. air for 24 hours. Sample 2 was immersed in a 3 percent polyethylene oxide in water solution and stirred for 15 minutes. Then the coal was drained and exposed to room temperature for 4 hours. A small 100 milligram portion (Sample 2A) of Sample 2 was exposed to air at 50° C. for 2 hours.

The percent moisture was determined on three portions of each of the three samples using a Perkin-Elmer TGS-II. The TGS was then flushed with nitrogen at 300 cubic centimeters per minute for 5 minutes. The sample (a 20–40 milligram portion of one of the samples) was loaded. The moisture content was obtained by heating the sample to 105° C. for 10 minutes while under nitrogen purge. The percent weight loss was due to loss of moisture.

| Sample | Moisture Content (%) Trial 1 | Trial 2 | Trial 3 | Average |
|---|---|---|---|---|
| 1 (Control) | 17.68 | 18.23 | 17.87 | 17.93 |
| 2 | 11.15 | 11.09 | 10.99 | 11.08 |
| 2A | 7.92 | 8.21 | 7.90 | 8.01 |

It can be seen from the above Table that the treatment of coal with a 3 percent solution of polyethylene oxide in water greatly reduces the moisture content of the coal.

EXAMPLE 3

Ten gram samples of coals of increasing rank were treated with solutions of three different molecular weights of polyethylene oxide and exposed to ambient conditions for 24 hours. An untreated control sample of each type of coal was also exposed to ambient conditions for 24 hours. The following table shows the results:

| Coal Type | Control | 10 ml of 10% PEO MW 300,000 | 10 ml of 5% PEO MW 900,000 | 10 ml of 1% PEO MW 4MM |
|---|---|---|---|---|
| Peat | 61% | 25% | 25% | 30% |
| Lignite | 15.2% | 5.0% | 7.7% | 7.2% |
| Sub-bitum. | 23% | 14% | 13% | 15% |
| High Volatile Bituminous | 10.8% | 8.0% | 8.4% | 8.2% |
| Med. Volatile Bituminous | 11.1% | 10.8% | 10.8% | 10.9% |

It is apparent from the above table that the moisture reduction process of the present invention does indeed reduce the moisture content of various kinds of coal. It is also apparent that the process is less effective on higher ranking coals. It is theorized that the higher ranking coals such as medium volatile bituminous coal have a less continuous pore structure restricting migration of polyethylene oxide into the pores so that little of the inherent moisture is absorbed by the polyethylene oxide solution for migration to the surface.

EXAMPLE 4

Ten gram samples of lignite coal with the moisture content of 15.2 percent were immersed in various solutions of polyethylene oxide, drained, and then exposed to ambient conditions for a period of 24 hours. The results of these tests are shown in the following table:

| MW | Concent. | Ml of Soln. Applied | G PEO Applied | Moisture Content After Drying |
|---|---|---|---|---|
| 1000 | 20% | 2.5 | .5 | 13.8 |
| | | 5.0 | 1.0 | 13.4 |
| | | 10.0 | 2.0 | 13.2 |

-continued

| MW | Concent. | Ml of Soln. Applied | G PEO Applied | Moisture Content After Drying |
|---|---|---|---|---|
| | 10% | 2.5 | .25 | 14.4 |
| | | 5.0 | .5 | 14.2 |
| | | 10.0 | 1.0 | 14.1 |
| 20,000 | 20% | 2.5 | .5 | 13.5 |
| | | 5.0 | 1.0 | 13.3 |
| | | 10.0 | 2.0 | 13.1 |
| | 10% | 2.5 | .25 | 15.2 |
| | | 5.0 | .5 | 15.0 |
| | | 10.0 | 1.0 | 14.7 |
| | 5% | 5.0 | .5 | 15.4 |
| 100,000 | 10% | 5.0 | .5 | 13.6 |
| | | 10.0 | 1.0 | 13.0 |
| | 5% | 5.0 | .25 | 14.4 |
| | | 10.0 | .5 | 13.9 |
| 300,000 | 10% | 5.0 | .5 | 6.9 |
| | | 10.0 | 1.0 | 5.0 |
| | 5% | 5.0 | .25 | 10.4 |
| | 10.0 | .5 | 6.1 | |
| | 3% | 5.0 | .15 | 14.2 |
| | | 10.0 | .3 | 10.1 |
| | 2% | 5.0 | .1 | 14.2 |
| | | 10.0 | .2 | 13.7 |
| 900,000 | 10% | 5.0 | .5 | 6.2 |
| | | 10.0 | 1.0 | 7.7 |
| | 2% | 5.0 | .1 | 15.0 |
| | | 10.0 | .2 | 8.1 |
| | 1% | 5.0 | .05 | 14.9 |
| | | 10.0 | .1 | 14.3 |
| 4MM | 1.0% | 5.0 | .05 | 8.4 |
| | | 10.0 | .10 | 7.2 |
| | .5% | 5.0 | .025 | 13.1 |
| | | 10.0 | .05 | 9.2 |
| | .2% | 5.0 | .01 | 14.1 |
| | | 10.0 | .02 | 14.0 |

The above Table clearly shows the effectiveness of the process of the present invention. Polyethylene oxides with a molecular weight of 100,000 or less were clearly ineffective for reducing moisture but the polyethylene oxides with a molecular weight of 300,000 and more were effective under the appropriate conditions.

EXAMPLE 5

Ten gram samples of sub-bituminous coal were immersed in various solutions of polyethylene oxide, removed, and then exposed to ambient conditions for 24 hours. The results of these tests are shown in the following table:

| Molecular Weight | Concent. | Ml Applied | g Applied | Moisture | Approximate Reduction |
|---|---|---|---|---|---|
| None | — | — | — | 20.5 | 0 |
| 20,000 | 20% | 10.0 | 2.0 | 19.0 | 0 |
| | 20% | 5.0 | 1.0 | 18.9 | 0 |
| | 20% | 2.5 | .5 | 19.3 | 0 |
| | 10% | 10.0 | 1.0 | 19.5 | 0 |
| | 10% | 5.0 | .5 | 19.8 | 0 |
| | 10% | 2.5 | .25 | 20.0 | 0 |
| | 5% | 10.0 | .5 | 20.4 | 0 |
| | 5% | 5.0 | .25 | 22.1 | 0 |
| 100,000 | 20% | 10.0 | 2.0 | 18.5 | 0 |
| | 20% | 5.0 | 1.0 | 18.8 | 0 |
| | 20% | 2.5 | .5 | 19.0 | 0 |
| | 10% | 10.0 | 1.0 | 18.7 | 0 |
| | 10% | 5.0 | .5 | 18.6 | 0 |
| | 10% | 2.5 | .25 | 20.4 | 0 |
| | 5% | 10.0 | .5 | 20.1 | 0 |
| | 5% | 5.0 | .25 | 20.6 | 0 |
| 300,000 | 10% | 10.0 | 1.0 | 10.1 | 50 |
| | 10% | 5.0 | .5 | 11.8 | 40 |
| | 10% | 2.5 | .25 | 14.0 | 30 |
| | 5% | 10.0 | .5 | 11.5 | 40 |

-continued

| Molecular Weight | Concent. | Ml Applied | g Applied | Moisture | Approximate Reduction |
|---|---|---|---|---|---|
| | 5% | 5.0 | .25 | 14.1 | 30 |
| | 5% | 2.5 | .125 | 18.4 | 10 |
| | 2% | 10.0 | .2 | 15.2 | 25 |
| | 2% | 5.0 | .1 | 19.4 | 0 |
| | 2% | 2.5 | .05 | 20.1 | 0 |
| | 1% | 10.0 | .1 | 19.2 | 0 |
| | 1% | 5.0 | .05 | 20.0 | 0 |
| | 1% | 2.5 | .025 | 21.0 | 0 |
| 0 | 0 | 0 | 0 | 20.4 | 0 |
| 900,000 | 10 | 10 | 1 | 8.1 | 60 |
| | 10 | 5 | .5 | 10.4 | 50 |
| | 10 | 2.5 | .25 | 14.2 | 35 |
| | 5 | 10 | .5 | 10.9 | 45 |
| | 5 | 5 | .25 | 15.3 | 25 |
| | 5 | 2.5 | .125 | 18.7 | 10 |
| | 2 | 10 | .2 | 16.0 | 20 |
| | 2 | 5 | .1 | 19.0 | 0 |
| | 2 | 2.5 | .05 | 20.1 | 0 |
| | 1 | 10 | .1 | 19.2 | 0 |
| | 1 | 5 | .05 | 20.3 | 0 |
| | 1 | 2.5 | .025 | 19.1 | 0 |
| 4 million | 2.0 | 10 | 0.2 | 10.1 | 50 |
| | 2.0 | 5 | 0.1 | 9.8 | 55 |
| | 2.0 | 2.5 | 0.05 | 10.3 | 50 |
| | 1.0 | 10 | .1 | 9.7 | 55 |
| | 1.0 | 5 | .05 | 11.2 | 45 |
| | 1.0 | 2.5 | .025 | 10.9 | 45 |
| | 0.5 | 10 | .05 | 10.7 | 45 |
| | 0.5 | 5 | .025 | 8.6 | 55 |
| | 0.5 | 2.5 | .0125 | 16.3 | 20 |
| | 0.2 | 10 | .02 | 8.7 | 55 |
| | 0.2 | 5 | .01 | 13.4 | 33 |
| | 0.2 | 2.5 | .005 | 18.7 | 10 |
| | 0.1 | 10 | .01 | 13.1 | 33 |
| | 0.1 | 5 | .005 | 17.8 | 10 |
| | 0.1 | 2.5 | .0025 | 19.3 | 0 |

The above Table clearly shows the effectiveness of the process of the present invention. Polyethylene oxides with a molecular weight of 100,000 or less were clearly ineffective for reducing moisture but the polyethylene oxides with a molecular weight of 300,000 and more were effective under the appropriate conditions.

EXAMPLE 6

Ten gram samples of high volatile bituminous B coal immersed in various solutions of polyethylene oxide, removed, and then left in ambient conditions for 24 hours. The results of these tests are shown in the following table:

| Molecular Weight | Concent. | Ml Applied | g Applied | Moisture | Approximate Reduction |
|---|---|---|---|---|---|
| None | — | — | — | 10.3 | — |
| 300,000 | 10 | 10 | 1 | 7.2 | 30 |
| | 10 | 5 | .5 | 8.4 | 20 |
| | 10 | 2.5 | .25 | 9.8 | 0 |
| | 5 | 10 | .5 | 8.3 | 20 |
| | 5 | 5 | .25 | 9.9 | 0 |
| | 5 | 2.5 | .125 | 10.4 | 0 |
| | 2 | 10 | .2 | 8.1 | 20 |
| | 2 | 5 | .1 | 9.4 | 10 |
| | 2 | 2.5 | .05 | 9.9 | 0 |
| | 1 | 10 | .1 | 10.0 | 0 |
| | 1 | 5 | .05 | 10.0 | 0 |
| | 1 | 2.5 | .025 | 10.2 | 0 |
| 900,000 | 10 | 10 | 1.5 | 6.8 | 30 |
| | 10 | 5 | .25 | 8.0 | 20 |
| | 10 | 2.5 | .5 | 9.8 | 5 |
| | 5 | 10 | .25 | 8.1 | 20 |

-continued

| Molecular Weight | Concent. | Ml Applied | g Applied | Moisture | Approximate Reduction |
|---|---|---|---|---|---|
| | 5 | 5 | .125 | 9.7 | 5 |
| | 5 | 2.5 | .2 | 10.1 | 0 |
| | 2 | 10 | .1 | 9.8 | 0 |
| | 2 | 5 | .05 | 9.9 | 0 |
| | 2 | 2.5 | .1 | 10.3 | 0 |
| | 1 | 10 | .05 | 10.1 | 0 |
| | 1 | 5 | .025 | 10.4 | 0 |
| | 1 | 2.5 | — | 10.2 | 0 |
| 4 million | 1.0 | 10 | .01 | 8.2 | 20 |
| | 1.0 | 5 | .05 | 9.5 | 10 |
| | 1.0 | 2.5 | .025 | 9.9 | 0 |
| | .5 | 10 | .05 | 9.7 | 0 |
| | .5 | 5 | .025 | 10.1 | 0 |
| | .5 | 2.5 | .0125 | 10.4 | 0 |
| | .2 | 10 | .02 | 10.2 | 0 |
| | .2 | 5 | .01 | 10.2 | 0 |
| | .2 | 2.5 | .005 | 10.4 | 0 |
| | .1 | 10 | .01 | 10.1 | 0 |
| | .1 | 5 | .005 | 9.9 | 0 |
| | .1 | 2.5 | .0025 | 10.3 | 0 |
| | 2.0 | 10 | .02 | 7.7 | 25 |

The above data clearly shows that acceptable moisture reduction can be obtained by using polyethylene oxide of a molecular weight of at least 300,000 in aqueous solution to treat moisture-laden in coal.

EXAMPLE 7

Ten grams samples of peat were immersed in various solutions of polyethylene oxide, removed, and then exposed to ambient conditions for 24 hours. The results of these tests are shown in the following table:

| Molecular Weight | Concent. | Ml Applied | g Applied | Moisture | Approximate Reduction |
|---|---|---|---|---|---|
| None | — | — | — | 46.1 | — |
| 100,000 | 10 | 10 | 1 | 40.8 | 10 |
| | 10 | 5 | .5 | 42.1 | 10 |
| | 10 | 2.5 | .25 | 43.0 | 5 |
| | 5 | 10 | .5 | 41.9 | 10 |
| | 5 | 5 | .25 | 40.8 | 10 |
| | 5 | 2.5 | .125 | 45.4 | 0 |
| | 2 | 10 | .2 | 45.1 | 0 |
| | 2 | 5 | .1 | 46.0 | 0 |
| | 2 | 2.5 | .05 | 47.2 | 0 |
| 300,000 | 10 | 10 | 1 | 25.2 | 45 |
| | 10 | 5 | .5 | 31.1 | 33 |
| | 10 | 2.5 | .25 | 40.3 | 10 |
| | 5 | 10 | .5 | 30.8 | 33 |
| | 5 | 5 | .25 | 41.4 | 10 |
| | 5 | 2.5 | .125 | 45.7 | 0 |
| | 2 | 10 | .2 | 41.0 | 10 |
| | 2 | 5 | .1 | 46.0 | 0 |
| | 2 | 2.5 | .05 | 45.9 | 0 |
| | 1 | 10 | .1 | 45.9 | 0 |
| | 1 | 5 | .05 | 46.1 | 0 |
| | 1 | 2.5 | .025 | 46.4 | 0 |
| 900,000 | 10 | 10 | 1 | 21.1 | 55 |
| | 10 | 5 | .5 | 26.1 | 45 |
| | 10 | 2.5 | .25 | 31.7 | 33 |
| | 5 | 10 | .5 | 28.1 | 35 |
| | 5 | 5 | .25 | 32.4 | 33 |
| | 5 | 2.5 | .125 | 39.0 | 10 |
| | 2 | 10 | .2 | 35.0 | 25 |
| | 2 | 5 | .1 | 39.7 | 10 |
| | 2 | 2.5 | .05 | 42.3 | 5 |
| | 1 | 10 | .1 | 40.3 | 10 |
| | 1 | 5 | .05 | 44.6 | 0 |
| | 1 | 2.5 | .025 | 47.3 | 0 |

The above Table shows that the use of polyethylene oxide with a molecular weight of 100,000 did not provide sufficient moisture reduction whereas the use of higher molecular weight polyethylene oxides did provide sufficient, and under the proper conditions superior, moisture reduction. This is significant because peat has a considerably higher moisture content than other types of coal.

EXAMPLE 8

Three 20-gram samples of sub-bituminous coal were treated with 5 milliliters of various polyethylene oxide (molecular weight 300,000) solutions and allowed to stand at ambient conditions. The moisture level was then determined. An untreated sample of the same coal was also allowed to stand at ambient conditions and the moisture content was monitored. The results of this experiment are shown in the following table:

| | Moisture level | | | | | | | | |
|---|---|---|---|---|---|---|---|---|---|
| Time in Minutes | 0 | 5 | 10 | 15 | 30 | 60 | 120 | 180 | 240 |
| Untreated | 20.5 | 18.7 | 17.6 | 17.5 | 16.9 | 15.8 | 15.8 | 15.7 | 15.8 |
| 5% PEO in $H_2O$ | — | 24.3 | 24.2 | 24.0 | 22.6 | 12.7 | 9.3 | 8.3 | 8.3 |
| 5% PEO in 66% $H_2O$, 33% MeOH | — | 20.8 | 16.8 | 14.7 | 9.3 | 8.4 | 8.4 | 8.4 | 8.4 |
| 5% PEO in 50% $H_2O$, 50% MeOH | — | 19.5 | 14.3 | 10.3 | 8.2 | 8.2 | 8.2 | 8.2 | 8.2 |

The above Table shows that solutions of polyethylene oxide in water and in a water and methanol mixture will provide the moisture reduction advantages of the present invention. However, it is clearly shown that the moisture reduction occurs much faster if a solution of polyethylene oxide in methanol and water is utilized instead of a solution of polyethylene oxide in water alone. It is theorized that the reason for this faster drying time is the higher volatility of the methanol.

We claim:

1. A method for reducing the moisture content of coal which comprises contacting the coal with an aqueous composition comprising at least about 0.1 percent of polyethylene oxide with a molecular weight of at least about 200,000 and then evaporating the water whereby at least about one gram of polyethylene oxide per 1000 grams of coal is deposited upon the coal.

2. The method of claim 1 wherein the concentration of the polyethylene oxide is at least about 2 percent, the molecular weight of the polyethylene oxide is at least about 300,000, and at least about 20 grams of polyethylene oxide per 1000 grams of coal are deposited upon the coal.

3. The method of claim 1 wherein the concentration of the polyethylene oxide is at least about 2 percent, the molecular weight of the polyethylene oxide is at least about 900,000, and at least about 20 grams of polyethylene oxide per 1000 grams of coal are deposited upon the coal.

4. The method of claim 1 wherein the concentration of the polyethylene oxide is at least about 0.1 percent, the molecular weight of the polyethylene oxide is at least about 4,000,000, and at least about 1 gram of polyethylene oxide per 1000 grams of coal is deposited upon the coal.

5. The method of claim 1 wherein the water is evaporated at a temperature of about 0° C. or above.

6. The method of claim 5 wherein the evaporation period is at least about 2 hours.

7. The method of claim 1 wherein the aqueous solution is comprised of polyethylene oxide, water, and methanol.

8. The method of claim 1 wherein the aqueous composition is contacted with the coal by spraying it onto the coal.

9. The method of claim 1 wherein the aqueous solution is contacted with the coal by immersing the coal in the aqueous solution.

* * * * *